United States Patent [19]

Katchka

[11] 4,106,889

[45] Aug. 15, 1978

[54] BURNER IGNITION SYSTEM

[75] Inventor: Jay R. Katchka, Cypress, Calif.

[73] Assignee: Robertshaw Controls Company, Richmond, Va.

[21] Appl. No.: 743,297

[22] Filed: Nov. 19, 1976

[51] Int. Cl.[2] ..... F23Q 9/08

[52] U.S. Cl. ..... 431/46; 431/53

[58] Field of Search ..... 431/43, 45, 46, 53, 431/54

[56] References Cited

U.S. PATENT DOCUMENTS

| | | | |
|---|---|---|---|
| 2,730,169 | 1/1956 | Deubel | 431/45 |
| 2,751,972 | 6/1956 | Loeber | 431/46 |
| 2,947,836 | 8/1960 | Ray | 236/68 B |
| 2,981,324 | 4/1961 | Deziel | 431/46 |
| 3,395,968 | 8/1968 | Mobarry et al. | 431/45 |
| 3,501,253 | 3/1970 | Wade | 431/43 |

FOREIGN PATENT DOCUMENTS

| | | | |
|---|---|---|---|
| 792,930 | 4/1958 | United Kingdom | 431/46 |

*Primary Examiner*—Carroll B. Dority, Jr.

*Attorney, Agent, or Firm*—Fulwider, Patton, Rieber, Lee & Utecht

[57] ABSTRACT

There is disclosed an electrical control system for the ignition of a burner such as a burner for household appliances having an interrupted pilot burner operation. The pilot burner is supplied with fuel by the first control valve which is activated open by the switch of the thermostat in response to heating demand. A combustion detection switch is provided at the pilot burner to activate a second control valve in the gas line to the main burner in response to the presence of a pilot burner flame. This flame switch has hot and cold contacts which are in control circuits to relays that operate switches in circuit to the ignition circuit and to a time operated deactivating switch. The opperations of these relays insure the inhibition of the ignition circuit once the second controlled valve is opened and the complete deactivation of the control system in the event that a pilot burner flame is not established within a predetermined time. The control system also provides for recycling of the operation in the event that the heating demand signal from the thermostat or power supply to the system is interrupted at any time during its operation.

19 Claims, 3 Drawing Figures

BURNER IGNITION SYSTEM

BACKGROUND OF THE INVENTION

The typical heating appliance which employs a combustible fuel has, heretofore, employed a constantly burning pilot burner to ignite fuel discharge from the main burner in response to heating demand. The increasing concern over dwindling energy resources has promoted interest in heating appliances having interrupted pilot burner operation. Past history has demonstrated a very high degree of safety and reliability in appliances utilizing standing, or continuously burning, pilots. It is the intent of interrupted pilot burner systems to equal, or surpass, such a degree of safety and reliability.

A number of control circuits, chiefly of solid state and/or digital design, have been developed to prevent the accumulation of any substantial quantity of unburnt conbustible fuel in the heating appliance. Generally these devices have employed flame responsive sensors positioned adjacent the pilot burner to generate control signals for the circuit which are indicative of the absence or presence of a pilot burner flame.

A difficulty with solid state control circuits when employed in a household appliance that is susceptible of a potentially hazardous operation is that most solid state devices have a multitude of possible failure states. Thus, although solid state devices are quite reliable in freedom from failure, the multiple manners in which these devices can fail presents a circuit designer with almost insurmountable difficulties in designing a fail-safe circuit for all potential modes of failure.

Attempts to provide an entirely fail-safe control circuit utilizing entirely solid state and/or digital devices thus results in development of control circuits of ever and ever increasing complexity, further increasing the probability of failure of the circuit.

BRIEF STATEMENT OF THE INVENTION

This invention comprises a burner control system with a pilot burner of interrupted operation and with a control circuit therefor that provides for reliable and safe operation. The burner system includes a main burner and a pilot burner for ignition with gas supply thereto through first and second normally closed control valves. The pilot burner is supplied with combustible fuel from the first control valve. The heating demand switch, such as a switch of a thermostat and the like, is in a circuit to the energizing coil of a first relay through the cold position pole of a combustion detection switch that is positioned to respond to the absence or presence of a flame at the pilot burner. The ignitor circuit is activated by a circuit that is interrupted when gas is supplied to the main burner. Preferably the system circuit is also provided with a deactivating or lock out switch provided with a timer circuit which is activated by the thermostatic switch inhibited by a control circuit through the hot pole of the combustion detection switch whereby the timer circuit of the deactivating switch is inhibited off after the pilot burner flame has heated the combustion detection switch sufficiently to move it to its hot pole.

BRIEF DESCRIPTION OF THE DRAWINGS

The invention will be described with reference to the FIGURES of which.

DESCRIPTION OF THE PREFERRED EMBODIMENT

Figure 1:
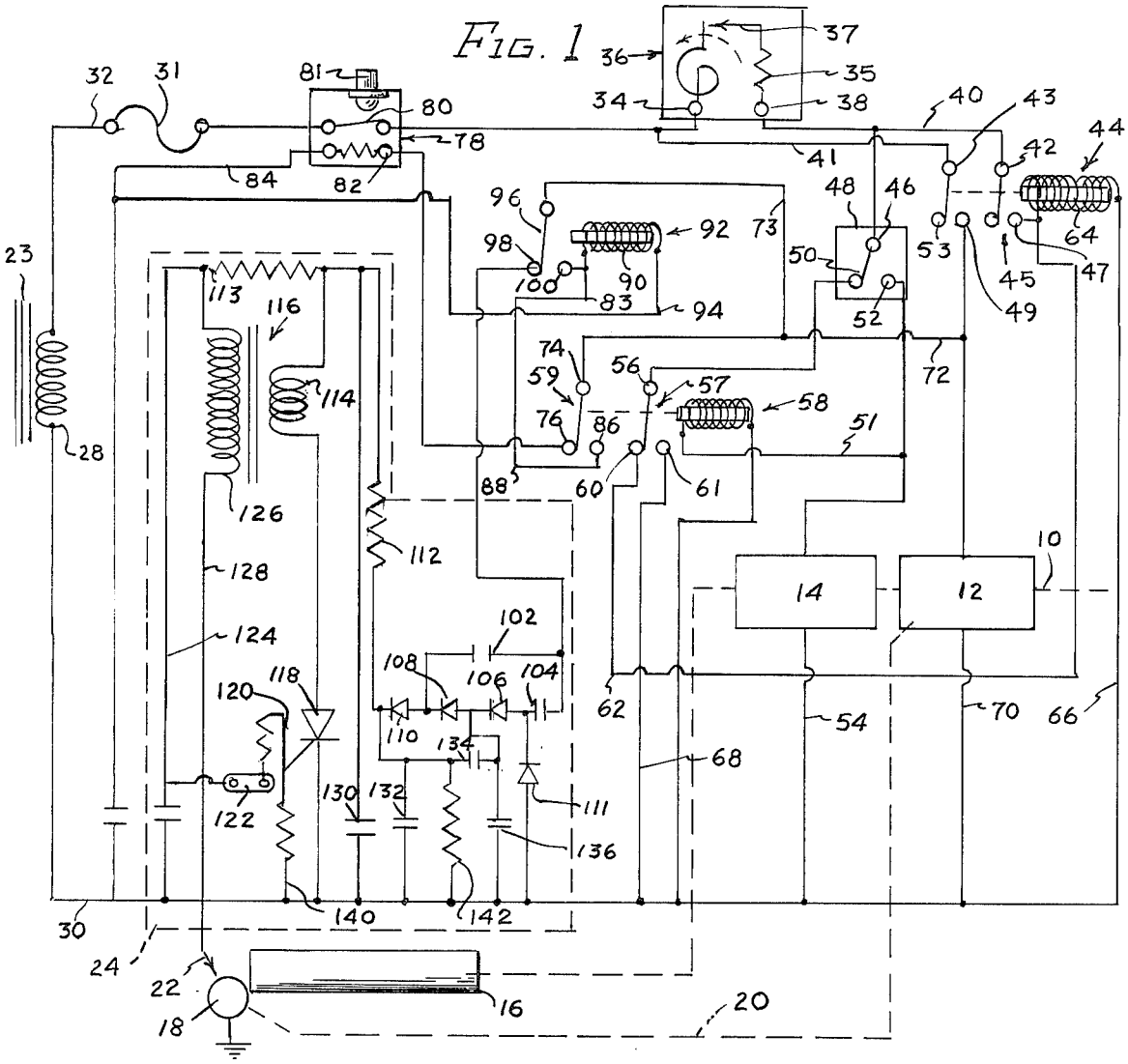
FIG. 1 is an electrical schematic of the control system.

Referring to FIG. 1, the appliance burner with the interrupted pilot burner is shown as having a main supply conduit 10 for the supply of a combustible fuel such as propane, natural gas, etc. The main supply line 10 has a first control valve 12 and a second control valve 14 in series therewith. The main supply line 10 communicates downstream of second control valve 14 with the main burner 16 of the appliance. The burner system includes a pilot burner 18 that is supplied with the combustible fuel through supply line 20 which communicates with the source of combustible fuel through the first control valve 12, bypassing the second control valve 14. The pilot burner has ignition facilities including a sparking electrode 22 which is in circuit with an ignition circuit generally indicated as 24.

The electrical circuit for opration and control of the aforedescribed burner system includes a transformer 23 having its primary winding (not shown) connected for supply of line voltage, typically of a nominal 110–120 alternating current voltage. The secondary winding 28 of transformer 23 provides the operational voltage supplied for the control system; typically about 24 volts alternating current is developed across the terminals of this winding. The terminals are connected to a ground buss 30 and a conductor 32 which extends through fuse 31 to a pole 34 of a heating demand sensor such as a typical room thermostat 36 and the like. The opposite pole 38 of the thermostat is connected through lead 40 to the switch pole 42 of a first switch of relay 44 and to the switch pole 46 of the combustion detection switch 48.

Combustion detection switch 48 is positioned adjacent the pilot burner 18 for contact with the burner flame therefrom. The combustion detection switch can be any suitable temperature responsive means such as a thermocouple, bimetallic member, diostat, etc. Of these, a diostate, which comprises a bulb filled with a temperature responsive liquid, is preferred. This switch has a thermal inertia or heat sink and requires a finite time for response to a changed condition. With the preferred diostat, the interia is the heat capacity of the termally expanding liquid such as mercury. The combustion detection switch has a cold position pole 50 and a hot position pole 52. The hot position pole is in circuit with the solenoid of second control valve 14, and to the ground buss 30 through lead 54. The cold pole of combustion detection switch 48 is connected to the switch pole 56 of relay 58. Relay 58 has two switch members, 57 and 59. Its energizing coil is supplied with circuit voltage through lead 51. The normally closed pole 60 of the first switch 57 of this relay is connected through conductor 62 to the energizing coil 64 of the relay 44 and then to the ground buss 30 through conductor 66. The normally open pole 61 of the first switch 57 is connected to the ground buss 30 by lead 68.

Relay 44 has two switches, 43 and 45. Switch 45 has its normally open pole 53 in circuit with the energizing coil 64 of this relay to maintain the coil energized once the circuit is activated by the heating demand through the cold pole of combustion detection switch 48 and relay 58. The second switch 43 is supplied with voltage through line 41 which bypasses thermostat 36. Switch 43 has a normally open contact 49 which is in circuit to the solenoid of normally closed control valve 12 and then to the ground buss 30 through lead 70. The normally open pole 49 of switch 43 is also connected through lead 72 to the switch pole 74 of the second switch 59 of the relay 58.

The normally closed ple 76 of switch 59 is in circuit to the lock out switch 78 of the circuit. The lock out switch, as previouly mentioned, has a timer controlled switch lever 80 in the conductor 32 supplying the electrical voltage to the circuit. The illustrated timer mechanism includes an electrical heating means such as resistor 82 which is in heat exchange relationship with the switch 80 which can be of a bimetallic construction and which is normally closed but which opens when heated to a predetermined temprature that is reached after a preset time interval, e.g., from 90 to about 180 seconds of current flow through resistor 82. Resistor 82 is connected to the ground buss 30 through lead 84. The lock out switch 78 has a manual reset lever 81 which must be manually reset once bimetallic switch 80 opens.

The normally open pole 86 of switch 59 is in circuit through lead 88 with the coil 90 of a third relay 92. The coil 90 is in circuit to ground buss 30 through lead 94. Relay 92 has a switch 96 with its normally closed pole 98 in circuit to the ignition circuit 24 to supply the activating electrical voltage thereto. The normally open pole 100 of switch 96 is in circuit to the energizing coil 90, serving as a holding circuit to maintain this coil energized, once activated.

The ignitor circuit 24 includes a voltage multiplier circuit comprised of capacitors 102, 104, 134 and 136 and diodes 106, 108, 110 and 111 to increase the peak circuit voltage derived from transformer 23 from approximately 34 volts to 136 volts. This increased voltage is supplied to filter capacitor 132 and through resistor 112 to capacitor 130 in the capacitive discharge network. The increased voltage is also supplied to the primary winding 114 of transformer 116 through a silicon control rectifier (SCR) 118 which is gated through a control circuit which includes resistor 113, lead 124 and neon lamp 122. Winding 126 is connected through lead 128 to spark electrode 22.

This conventional circuit is modified in accordance with the invention by providing a discharge lead 140 with a resistor 142 of sufficient impedance to provide discharge to ground buss 30 of any residual charge on the capacitors once the ignition circuit is deactivated through switch 96.

The operation of the circuit will be described briefly as follows. Upon a demand for heat, which is sensed by the thermostat 36, the thermostat switch 37 closes and the supply circuit voltage is applied to the energizing coil 64 of relay 44 through the combustion detection switch 46 which is in its cold position and through the normally closed pole 60 of switch 57. Energizing coil 64 supplies the circuit voltage from lead 32 through switch 43 to the first control valve 12. The circuit voltage is also applied to coil 64 from lead 40 through contact 47, serving as a latching circuit for relay 44. The valve 12 opens and supplies gas to the second control valve 14, which remains in its normally closed position. The first control valve 12 also supplies fuel, such as gas, through line 20 to the pilot burner 18. The circuit voltage is also supplied through lead 72 and switch 59 to its normally closed pole 76 through the resistance heater 82 of the timer lock out switch 78. The supply voltage is also supplied through lead 73 to switch 96 of relay 92 and to its normally closed contact 98 which is in circuit to the ignitor circuit 24, activating this circuit and sparking electrode 22 for ignition of the fuel discharged at the pilot burner 18.

The initiation of the flame at pilot burner 22 will heat the combustion detection switch 48. The switch 48 has a thermal inertia and is responsive to the burner flame to move to is hot pole 52 in a time period from 20 to about 40, preferably from 20 to about 25, seconds. The closing of this switch through hot pole 52 supplies the circuit voltage from lead 40 to the second control valve 14, opening this valve and directing combustible fuel to main burner 16.

The movement of the combustion detection switch from its cold pole 50 removes the supply of circuit voltage through line 62 to energizing coil 64 of relay 44. This coil remains energized, however, since switch 45 of this relay is closed, functioning as a holding switch for continued energizing of the relay coil.

The application of the circuit voltage to pole 52 of the combustion detection switch also supplies the circuit voltage through lead 51 to the energizing coil of relay 58. This removes switch 59 from the normally closed pole 76 and inhibits any further operation of the lock out switch, interrupting the timer mechanism, resistor 82, of this switch. It also removes the application of the supply voltage to the ignition circuit 24, deactivating the ignition circuit in the following manner. The switch 59 moves to its normally open pole 86 and thereby applies the supply voltage to the energizing coil of relay 92. This causes switch 96 to move from its normally closed pole 98, removing the application of supply circuit voltage to the ignition circuit 24, deactivating the ignition circuit. Switch 96 moves to its normally open pole 100 thereby serving as a holding switch for maintaining relay 92 in an energized state which is no longer dependent on voltage from switch 59 and pole 76 of relay 58. Thus, ignition circuit 24 will remain deactivated for the remainder of the cycle.

When the termostat switch 37 opens, usually under the influence of an anticipator resistor heater contained within the thermostat, the voltage supply is removed from lead 40 supplying control valve 14 and relay coil 64 of relay 44; thus all circuits are deenergized, closing both valves and extinguishing both the main and pilot burners. With switches 43 and 45 in their normally open position, no source of supply voltage will be available to the lock out switch through line 72 and switch 59 of relay 58.

The combustion detection switch 48 cools, and its thermal inertia typically requires from 10 to 30, preferably from 20 to 25, seconds for it to cool sufficiently to permit switch 48 to move to the cold pole 50, resetting the circuit for a renewed operation upon closing of the thermostat switch 37.

The circuit as thus described is responsive to a number of abnormal conditions. If the pilot burner fails to ignite or the flame is not adequately established to heat the combustion detection switch sufficiently to move the switch to its hot pole 52 within a predetermined period, e.g., within 90 to about 180 seconds, the lock out switch 78 is opened, interrupting the voltage supply through lead 32 and permitting the control valve 12 to close and discontinue supply of gas to the pilot burner. Thereafter, it is necessary for the operator to reestablish the circuit, manually closing switch 80 by depressing button 81.

In the event that inadvertent or non-thermal operation of the thermostat occurs, such as electrical power interruption, manual tampering, etc., whereby the demand for heat is interrupted after the pilot burner is ignited but before the main burner is supplied with gas, the pilot burner will be extinguished. Since the combustion detection switch 48 is in contact with the cold pole 50, the system is ready for recycling upon reestablishing a demand signal from thermostat 36.

In the event that the main burner flame and the pilot flame are extinguished, e.g., by momentary interruption of gas flow or by a sudden draft, druing a heating demand operation of the system, the control system will respond to provide only a minimal flow of combustible fuel into the burner chamber of the appliance. The control system responds to the extinguishment of the flame of the main and/or pilot burner by the cooling of the combustion detection switch and moving of its switch lever to its cold pole. This will interrupt the supply of gas to the main burner by permitting control vavle 14 to move to its normally closed position. This will also interrupt the supply of voltage through line 51 to the energizing coil of relay 58, permitting switch 59 to move to its normally closed pole 76. Gas momentarily continues to be supplied to the pilot burner 18 through the first control valve 12 since the relay 64 remains energized through the holding pole 47 of switch 45. The closing of the switch 59 through pole 76, however, activates the time controlled lock out switch 78 and within its predetermined time period, e.g., about 1 minute, the bimetallic switch 80 is heated sufficiently to open and disable the system, permitting the relay switches to return to their normally open poles releasing the valve 12 to its normally closed position.

A momentary electrical interruption while the main burner is on results in extinguishment of the main burner flame since valves 12 and 14 respond by closing. If the electrical power is restored before the combustion detection switch cools sufficiently to move to its cold pole, valve 14 will open, however, gas will not be supplied to the main burner since valve 12 will remain closed as relay 44 moves to the normally open switch contact upon interruption of the electrical supply to its latching contact 47. When the combustion detection switch moves to its cold pole, either before or after restoration of the electrical supply, the circuit is restored for recycling upon receipt of a heating demand signal from the thermostat.

Once the flame at the pilot burner 18 is established for a sufficient time to move switch 48 to its hot contact, relay 92 is energized, through relay 58, and will remain energized through the holding pole 100 of switch 96 which is supplied with voltage through switch 43 of the relay 44, thus becoming independent of relay 58. In this position switch 96 is open in the circuit to the ignitor circuit 24 and the ignitor circuit 24 is disabled for the remainder of the cycle of the system. When the ignition circuit 24 is disconnected from the supply voltage, any residual charges on the capacitive network are dissipated through resistor 142 which is of sufficiently high impendance to avoid interference with the normal charging and discharging of the capacitive network but which has a sufficiently low impedance to permit a discharge of the capacitive network once the voltage supply to the circuit is interrupted.

Conductor 41, which bypasses thermostat 36, supplies the voltage to the first control valve 12, relay 92 and ignition circuit 24. This is preferred since it reduces the current flow through switch 37 of the thermostat. Commonly these thermostats have an anticipating heater (resistor 35) to heat the bimetallic switch lever and cause it to open the switch before it would otherwise respond to the surrounding temperature. This is conventional to avoid overshooting of the system. These thermostats, as a consequence, have a limited power rating and it is, therefore, preferred to reduce the electrical load on the thermostat 36 by the bypass conductor 41.

The control circuit is also provided with protection means to prevent operation in the event that an electrical short occurs between the hot and cold poles, 50 and 52, of the combustion detection switch 48 or in the leads which extend from these poles. This short will close switch 57 on pole 61 which is grounded by lead 68 to ground buss 30, thereby providing a direct ground connection through thermostat 36 and the cold pole 50 of switch 48. This will blow fuse 31 and disable the circuit.

Figure 2:
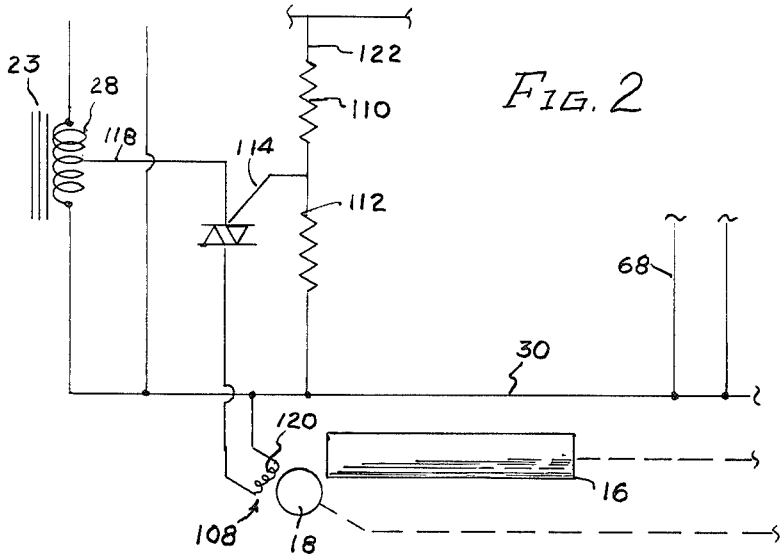
FIG. 2 is a schematic of an alternative ignition circuit.

Referring now to FIG. 2, there is disclosed an alternative ignition system utilizing a glow plug 108 rather than a spark ignition system. The ignition circuit for the system includes a voltage divider network of resistors 110 and 112 to provide a gating voltage that is applied to the gate terminal 114 of triac 116. Triac 116 is connected in circuit from a voltage supply through an intermediate tap 118 of the secondary windings 28 of transformer 23 (shown in FIG. 1) to the heating coil 120 of glow plug 108. The voltage divider network is connected through lead 122 to the normally closed contact 98 of switch 96 of relay 92, previously described. The remainder of the circuit and the system and its operation is substantially the same as that described with regard to FIG. 1.

The control circuit of this invention is of particular advantage with a glow plug ignition circuit since it provides for discontinuous energizing of the glow plug whereby the glow plug is energized only when needed, i.e, for ignition of the pilot burner flame. This greatly reduces the bulk and cost of the voltage supply transformer for the ignition circuit and extends the life of the glow plug element.

The invention can also be applied to a system when the valves in the pilot burner and main burner gas supply lines are independenly rather than serially connected. A system of this configuration employing a control circuit of the invention is shown in FIG. 3.

Figure 3:
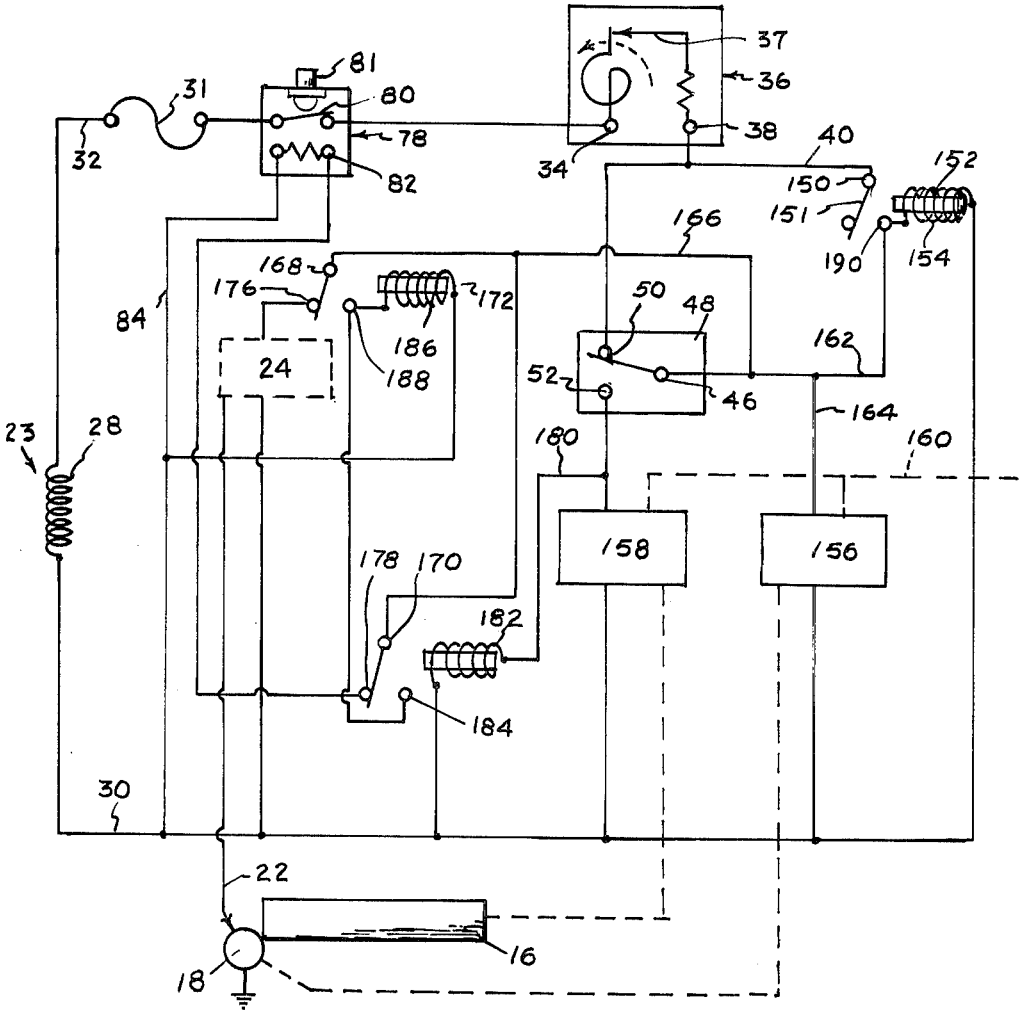
FIG. 3 is a schematic of an alternative control system.

The circuit shown in FIG. 3 has a power supply such as transformer 23 having a secondary winding 28 to supply the operation voltage for the system, typically about 24 volts alternating current. The terminals are connected to a ground buss 30 and a conductor 42 which extends through fuse 31 to a pole 34 of a heating demand sensor such as a typical room thermostat 36 and the like. The opposite pole 38 of the thermostat is connected through lead 40 to the switch pole 150 of a relay 152 and to the cold position pole 50 of a combustion detection switch 48. The switch pole 46 of this combustion detection switch is in circuit with the solenoid 154 of relay 152.

The appliance burner for the circuit has a main supply conduit 160 for the supply of combustible fuel such as propane, natural gas and the like. The main supply line is connected through pilot valve 156 and main valve 158 to the pilot burner 18 and the main fuel burner 16, respectively. The pilot burner has ignition facilities including a sparking electrode 22 which is in circuit with an ignition circuit generally indicated as 24.

The conductor 162 which extends from the switch pole 46 of the combustion detection switch 48 to solenoid 154 is also in circuit through conductor 164 to the solenoid of pilot valve 156 and is in circuit, through conductor 166 to the switch poles 168 and 170 of relays 172 and 174, respectively. These relays are normally biased to switch poles 176 and 178. Switch pole 176 is in circuit with ignitor circuit 24 while switch pole 178 is in circuit with the lock out switch 78.

Lock out switch 78 has a timer controlled switch lever 80 in the conductor 32 supplying the electrical voltage to the control circuit. The timer mechanism includes an electric heating means such as resistor 82 that is in heat exchange relationship with switch 80 which can be of a bimetallic construction and which is normally closed but which opens when heated to a predetermined temperature which is reached after a preset time interval, e.g., from 90 to about 180 seconds of current flow through resistor 82. Resistor 82 is connected to the ground bus 30 through lead 84. The lock out switch 78 has a reset lever 81 which must be manually reset once the bimetallic switch 80 opens to again restore the circuit and supply voltage to the control circuit.

The combustion detection switch 48 is located adjacent pilot burner 18 for contact with the burner flame therefrom. The combustion detection switch can be any suitable temperature responsive switch such as a thermocouple, bimetallic member, diostat, etc. As in the circuit previously described, it is preferred to use a diostat having a thermally expanding liquid such as mercury. The hot position pole 52 of this switch is in circuit with the solenoid of the main valve 158, which is in the gas supply line to the main burner. Contact pole 52 is also in circuit, through conductor 180, with solenoid 182 of relay 174. The normally open switch contact 184 of the switch relay 174 is in circuit with solenoid 186 of relay 172.

The normally open switch contacts 188 and 190 of relays 172 and 152, respectively, are in circuit to the solenoid windings 186 and 154 of these relays, whereby these contacts function in holding circuits for their respective relays.

The operation of the circuit of FIG. 3 is as follows. With a demand for heat sensed by thermostat 36, the thermostat switch 37 closes and the supply circuit voltage is applied through the cold switch contact 50 of flame switch 48 to conductor 162, thereby supplying voltage to the solenoid of pilot valve 156, opening this valve, and to solenoid 154 of relay 152, closing the switch 151 to contact 190, thereby locking the supply of voltage to conductor 162. The voltage on conductor 162 is also applied, through conductor 166 to the ignitor circuit 24 through switch contact 176 of relay 172 and to resistor 82 of lock out switch 78 through the switch contact 178 of relay 174. The activation of the ignitor circuit 24 will cause ignition of the gas discharge from the pilot burner by sparking electrode 22.

Initiation of the flame at pilot burner 22 will heat combustion detection switch 48. This switch has a thermal inertia, as previously described, and is responsive to move to its hot pole 52 in a period of time from 20 to about 40, preferably from 20 to about 25 seconds. Closing of this switch through hot pole 52 supplies the circuit voltage from conductor 162 to the main control valve 158, opening this valve and directing combustible fuel to main burner 16.

The movement of combustion detection switch from its cold pole 50 to hot pole 52 also supplies the circuit voltage through line 180 to the solenoid 182 of relay 174. This opens the relay circuit to contact 178 and closes the relay through contact 184, interrupting the current flow through resistor 82 and deactivating the lock out switch 78. The closing of the switch of relay 174 on pole 184 supplies the circuit voltage from conductor 166 to the solenoid 186 of relay 172. This moves the switch from contact 176 to contact 188, deactivating the ignitor circuit 24 and supplying circuit voltage through contact 188 to solenoid 186 of relay 172.

When the termostat switch 37 opens, usually under the influence of the anticipator resistor heater contained within the thermostat the voltage supply is removed from lead 153 in circuit to switch contact 150. This interrupts the voltage supply to conductor 162 and removes the voltage supply to the valve 156 in the pilot gas line and valve 158 in the main gas line. Since these valves are biased to normally closed positions, removal of the voltage supply to their solenoids will permit the valves to close and interrupt the gas supplies to the main burner 16 and pilot burner 18.

If the thermostat switch 37 closes before the flame switch 48 cools sufficiently to permit the switch to move to the cold contact 50, the solenoid 154 of relay 152 is not supplied with the circuit voltage and the entire circuit fis deactivated until the combustion detection switch cools sufficiently to permit the switch to move to the cold contact 50. When the switch moves to the cold contact 50, the circuit is reset for repeated operation.

If the pilot burner fails to ignite or the flame is not established to heat the combustion switch adequately to move the switch to its hot pole 52 within a predetermined time, e.g., switch 90 to about 180 seconds, the lock out switch 78 is opened, interrupting the voltage supply through lead 32 and permitting control valve 156 to close and interrupt the supply of gas to the pilot burner 18. Thereafter, it is necessary that the operator reestablish the circuit by manually closing switch 80 by depressing button 81.

In the event that the burner and pilot flames are extinguished, e.g., by momentary interruption of gas flow or by a sudden draft, during a heating demand operation of the system, the control system will provide only a minimal flow of combustible fuel into the burner chamber of the appliance. The control system responds to the extingushment of the flame of the main and pilot burner by cooling of the combustion detection switch and moving of its switch lever from the hot contact 52. This will interrupt the supply of gas to the main burner by permitting valve 158 to move to its normally closed position and removes voltage supply to the coil 182 of relay 174, permitting the relay switch to move to normally closed contact 178 and activating lock out switch 78. Since relay 152 remains latched with switch lever 151 on contact 190, voltage is continued to be supplied to the pilot valve 156 holding this valve open and is supplied to relay 172, latching this relay switch away from contact 176 which is in circuit to the ignitor circuit, thereby maintaining the ignitor circuit disabled. This condition will continue until the lock out switch 78 opens and interrupts voltage supply through lead 32, disabling the system and permitting pilot valve 156 to move to its normally closed position. Thereafter, an operator must manually reset the circuit by depressing button 81.

The invention had been described with reference to the illustrated and presently prefered mode of practice. It is not intended that the invention be unduly limited by this illustration of the preferred mode of practice. Instead, it is intended that the invention be defined by the means, and there obvious equivalents, set forth in the following claims.

What is claimed is:

1. An ignition and control system for ignition of fuel discharged from a burner assembly including a main fuel burner having a fuel supply line connected thereto and a pilot burner to ignite fuel discharged from said main burner and having a pilot fuel supply line extending thereto, which comprises:

ignition means to ignite fuel discharged from said pilot burner;

first and second controlled valves for serial positioning in said main fuel supply line with means to connect said pilot fuel supply line to the fuel supply downstream of said first controlled valve;

condition sensing means to transmit a heating demand signal to said control system;

combustion detection means having cold and hot signal generation states to generate cold and hot signals, responsive to the absence or presence, respectively, of a flame at said pilot burner;

control means having an output signal to activate said first controlled valve into an open position and to activate said ignition means in response to receipt of said heating demand signal and said cold signal;

means to apply said hot signal to said second controlled valve to open said valve in response to receipt of said hot signal from said combustion detection means;

ignition control means having an output to inhibit operation of said ignition means in response to receipt of a hot signal from said combustion detection means; and latching means, and means to apply said output signal of said igntion control means thereto, to maintain inhibition of said ignition means.

2. The ignition and control system of claim 1 wherein said condition sensing means is temperature responsive.

3. The ignition and control system of claim 2 wherein said condition sensing means is thermostatic means to sense a heating demand and having temperature responsive means to detect a heating demand and having temperature responsive signal transmitting means to transmit a heating demand signal to said control means.

4. The ignition and conrol system of claim 1 including timing control means, activated by said heating demand signal and inhibited by said hot signal, and operative to interrupt fuel supply to said system.

5. The ignition and control system of claim 4 wherein said timing control means is operative to close said first and second controlled valve means.

6. The ignition and control system of claim 1 wherein said combustion detection means is normally biased to its cold signal generation state in the absence of a flame at said pilot burner.

7. The ignition and control system of claim 1 including electrical circuit means having voltage supply means and wherein said ignition means, condition sensing means, combustion detection means and said control means are electrical circuit elements in circuit to said voltage supply means.

8. The ignition and control system of claim 7 wherein said condition sensing means is a thermostatic switch having anticipator means comprising electrical heating means and including by-pass circuit means between said voltage supply means and at least one of said electrical circuit elements in parallel electrical connection with said anticipator means.

9. The ignition and control system of claim 7 including fuse means in circuit with said voltage supply means and including shorting circuit means having normally open shorting switch means and shorting control means operatively connected thereto to close said shorting switch means upon simultaneous receipt of cold and hot signals from said combustion detection means.

10. The ignition and control system of claim 1 including electrical circuit means having supply voltage means and wherein said first controlled valve is a normally closed solenoid valve, said control means comprises a first electrical relay having a normally open pole in circuit from said supply voltage to the solenoid of said valve, and said combustion detection means is a flame responsive switch moveable between cold and hot switch poles.

11. The ignition and control system of claim 12 wherein said control means also includes second relay means with its normally closed switch pole in circuit from said supply voltage means, through the cold pole of said combustion detection means and said condition sensing means to the energizing coil of said first relay.

12. The ignition and control system of claim 11 wherein said first electrical relay has a normally open switch pole in circuit with its energizing coil.

13. The ignition and control system of claim 11 wherein the said cold pole of said combustion detection means is in circuit with the switch pole of said second relay means.

14. The ignition and control system of claim 13 including fusible means in said voltage supply means.

15. The ignition and control system of claim 10 wherein said second controlled valve is a normally closed solenoid valve with its solenoid in circuit to the hot pole of said combustion detection means.

16. The ignition and control system of claim 10 including timing control means comprising a normally closed, thermally responsive switch in said electric circuit means and electrical heating means in circuit to said condition sensing means.

17. The ignition and control system of claim 16 wherein said electrical heating means is in circuit with the normally closed switch pole of relay means having its energizing coil in circuit to said supply voltage means through normally open switch means with means to close said switch means in circuit to the hot pole of said combustion detection means.

18. The ignition and control system of claim 1 including electrical circuit means having voltage supply means and wherein said ignition means comprises an electrical ignition circuit and a voltage supply circuit connecting said voltage supply means through the normally open switch pole of relay means having its energizing coil in circuit with said voltage supply means through said condition sensing means.

19. The ignition and control system of claim 18 including second and thrid relay means with said second relay means having its energizing coil in circuit to said supply voltage means through the hot pole of said combustion detection means and its normally open switch pole in circuit to the energizing coil of said third relay means with the normally closed switch pole of said third relay means in said voltage supply circuit to said ignition circuit.

* * * * *

UNITED STATES PATENT OFFICE

CERTIFICATE OF CORRECTION

Patent No. 4,106,889 Dated August 15, 1978

Inventor(s) Jay R. Katchka

It is certified that error appears in the above-identified patent and that said Letters Patent are hereby corrected as shown below:

Claim 11, line 1, change "12" to --10--.

Signed and Sealed this

*Twenty-fourth* Day of *April 1979*

[SEAL]

*Attest:*

RUTH C. MASON
*Attesting Officer*

DONALD W. BANNER
*Commissioner of Patents and Trademarks*